US007950953B2

(12) United States Patent
Kuwahara et al.

(10) Patent No.: US 7,950,953 B2
(45) Date of Patent: May 31, 2011

(54) MULTICORE CABLE CONNECTOR WITH AN ALIGNMENT PLATE WITH A CABLE RECEIVING PORTION ON ONE SIDE AND A SUBSTRATE RECEIVING PORTION ON THE OTHER SIDE

(75) Inventors: Kenji Kuwahara, Tokyo (JP); Toshiroh Endoh, Yamagata (JP); Hiroyuki Matsuoka, Kanagawa (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/943,407

(22) Filed: Nov. 10, 2010

(65) Prior Publication Data

US 2011/0059643 A1 Mar. 10, 2011

Related U.S. Application Data

(63) Continuation of application No. 12/678,764, filed as application No. PCT/US2008/076872 on Sep. 18, 2008, now Pat. No. 7,857,657.

(30) Foreign Application Priority Data

Sep. 21, 2007 (JP) ..... 2007-245691

(51) Int. Cl.
*H01R 12/24* (2006.01)

(52) U.S. Cl. ..... 439/497

(58) Field of Classification Search ..... 439/497, 439/108, 493, 579, 931, 607.01
See application file for complete search history.

(56) References Cited

U.S. PATENT DOCUMENTS

| | | | | |
|---|---|---|---|---|
| 6,336,827 | B1 * | 1/2002 | Akama et al. | 439/607.46 |
| 6,685,501 | B1 * | 2/2004 | Wu et al. | 439/497 |
| 6,685,511 | B2 * | 2/2004 | Akama et al. | 439/607.46 |
| 6,739,904 | B2 * | 5/2004 | Wu | 439/497 |
| 6,764,342 | B2 | 7/2004 | Murayama | |
| 6,951,487 | B2 | 10/2005 | Ozai | |
| 7,052,311 | B2 | 5/2006 | Kondou | |
| 7,435,132 | B1 * | 10/2008 | Fong et al. | 439/497 |
| 7,497,724 | B1 * | 3/2009 | Fong et al. | 439/497 |

FOREIGN PATENT DOCUMENTS

| | | |
|---|---|---|
| JP | 2004-071287 | 3/2004 |
| JP | 2006-260850 | 9/2006 |

OTHER PUBLICATIONS

PCT International Search Report, PCT/US2008/076872.

* cited by examiner

*Primary Examiner* — Chandrika Prasad

(57) ABSTRACT

To provide a multicore cable connector in which alignment of signal lines of a cable and soldering of the signal lines to a wiring pattern of a substrate are facilitated, and impedance mismatch on the substrate is minimized. A multicore cable connector 1 includes a cable fixing member 2, an aggregate cable 3 accommodated in cable fixing member 2, an aligning plate 4 for aligning signal lines 312 included in aggregate cable 3, and a substrate 5 formed with a wiring pattern 53 conductively connected to signal lines 312 of aggregate cable 3.

4 Claims, 6 Drawing Sheets

MULTICORE CABLE CONNECTOR WITH AN ALIGNMENT PLATE WITH A CABLE RECEIVING PORTION ON ONE SIDE AND A SUBSTRATE RECEIVING PORTION ON THE OTHER SIDE

CROSS REFERENCE TO RELATED APPLICATIONS

This application is a continuation application of U.S. application Ser. No. 12/678,764, filed Mar. 18, 2010, now U.S. Pat. No. 7,857,657, which claims priority to national stage filing under 35 U.S.C. 371 of PCT/US2008/076872 filed Sep. 18, 2008, which claims priority to Japanese Application No. 2007-245691, filed Sep. 21, 2007, the disclosure of which is incorporated by reference in their entirety herein.

TECHNICAL FIELD

This invention relates to a multicore cable connector having a plurality of signal lines, or in particular, to a multicore cable connector for high-speed transmission.

BACKGROUND

With the extension of the high-speed transmission, more and more cable connectors including a greater number of signal lines than in the prior art have come to be used in the personal computer and the large-capacity memory device. On the other hand, the cable connector is required to be compact. Therefore, a multiplicity of signal lines are arranged with high density in the connector. In such a cable connector, the distance between the signal lines is so short that each signal line is required to be accurately connected conductively to the substrate by soldering, etc.

Japanese Unexamined Patent Publication No. 2003-109708, for example, discloses a multicore high-speed signal transmission connector in which "the thickness of an insulator plate is determined in such a manner that a pair of uncoated terminals are fitted on signal contacts arranged on the upper and lower surfaces of the insulator plate to hold the insulator plate from the upper and lower sides thereof without changing the pitch of the terminal pair at the end of each of a plurality of two-core cables are connected to a pair of the signal contacts arranged on the upper and lower plate surfaces."

Also, Japanese Unexamined Patent Publication No. 2006-260850 discloses a cable connector having "a configuration comprising a contact assembly so structured that contacts are built in an electrically insulating block unit, a relay substrate with an end connected to the contact on the back of the contact assembly and the other end having terminal pads juxtaposed, a cable having a plurality of coated wires each including a wire and an electrically insulating coating for coating the wire and a shield case covering the contact assembly, the relay substrate and the ends of the cable, wherein the forward ends of the wires of the coated cable are arranged fixedly on the terminal pad of the relay substrate, and wherein the portion of the wire of the coated cable exposed from the end of the coating is thinner than the wire, the thinned wire portion being fixed on the terminal pad."

Further, Japanese Unexamined Patent Publication No. 2004-31257 discloses "a cable connector connected with a plurality of balanced transmission cables, comprising a connector fitted on the mating connector, a signal contact and a ground contact held on the connector, a locator for holding the cable and a ground plate held on the locator, characterized in that the balanced transmission cable includes a plurality of signal lines and drain wires insulated from each other, the ground plate is connected with the drain wires, and the connector and the locator engage each other, so that the ground plate and the ground contact are interconnected while at the same time collaborating with each other to surround each of the signal lines of the plurality of the balanced transmission cables." In soldering a plurality of signal lines of a cable to a substrate, the wiring pattern formed on the substrate and each signal line are required to be set in position accurately. This positioning operation is generally difficult, and some conventional connectors include a somewhat complicated structure for the positioning requirement.

Also, in the case where the cable connector is used for high-speed transmission, the impedance is disturbed at some points in the connector. Specifically, in the internal portion of the cable where the signal lines are covered with an insulating coating with the outer periphery thereof covered by a conductive ground layer such as a copper foil, the distance between each signal line and the ground layer is constant along the length of the cable, and therefore, the impedance is also constant. On the other hand, a wiring pattern of a specified size is formed on the substrate of the cable connector, and therefore, the impedance of the portions subsequent to the substrate is also specified at a predetermined value. In the portion of each signal line with the coating thereof cut off and the end thereof soldered to the wiring pattern on the substrate, therefore, the exposed signal line is arranged adjacently to another signal line, sometimes resulting in the impedance disturbance. This impedance disturbance tends to increase especially in the high-speed transmission of high frequency, and once the disturbance exceeds a predetermined value, the waveform is disturbed and the signal quality reduced.

Accordingly, an object of at least one embodiment of this invention is to provide a structure of a multicore cable connector with a multiplicity cables aligned and electrically connected to the wiring pattern formed on the substrate, wherein the alignment and the soldering of the cable signal lines and the substrate wiring pattern are facilitated using a simple structure and the impedance disturbance on the substrate is suppressed to a minimum.

SUMMARY

In order to achieve the object described above, according to at least one embodiment of this invention, there is provided a multicore cable connector comprising: an aggregate cable including a plurality of single cables each having signal lines covered concentrically by an insulating coating and a ground layer with a conductive foil arranged around the signal lines, and conductive drain wires arranged along at least one ground layer of the plurality of the aggregated single cables; a substrate having a front surface and a back surface and a wiring pattern on each of the front surface and the back surface, a land constituting a contact with the mating connector at an end of the wiring pattern, and a signal line mounting portion and a drain wire mounting portion constituting contacts of the signal lines and the drain wires, respectively, at the other end of the wiring pattern; an aligning plate having a front surface and a back surface, a substrate receiving portion arranged on the front surface for receiving the substrate, an aligning plate having a plurality of vertically long through holes making up signal line receiving holes formed with the upper and lower ends thereof protruded from the upper and lower peripheral edges, respectively, of the substrate receiving portion for receiving each of the signal lines, and a plurality of drain wire receiving portions arranged at a distance from the substrate receiving portion for receiving the drain wires; and a cable fixing member for fixing the aggregate cable and the aligning plate integrally on the back surface of the aligning plate; wherein an mounting portion-side end of the substrate is received by the substrate receiving portion of the aligning plate, and the substrate is set in position with respect to the cable fixing member by fixing the aligning plate to the cable fixing member; wherein the end surface of the ground layer of the cable is arranged in contact with the back surface of the aligning plate, and the signal lines are exposed from the aligning plate on the front surface of the aligning plate, so that the two surfaces of the substrate are electrically connected with the mounting portion; and wherein the drain wires are wired on the front surface side of the aligning plate through the drain wire receiving portion, and at least one of the surfaces of the substrate is connected electrically with the mounting unit on the front surface.

With the multicore cable connector according to this invention, each signal line can be accurately set in position on the substrate by the aligning plate for positioning the signal lines having no insulating coating. Also, the area of the cable connector where the impedance disturbance can occur is limited substantially to the area of a length corresponding to the thickness of the aligning plate, and therefore, a cable connector free of the effects of the noise in high-speed transmission is provided.

DETAILED DESCRIPTION

Figure 1:
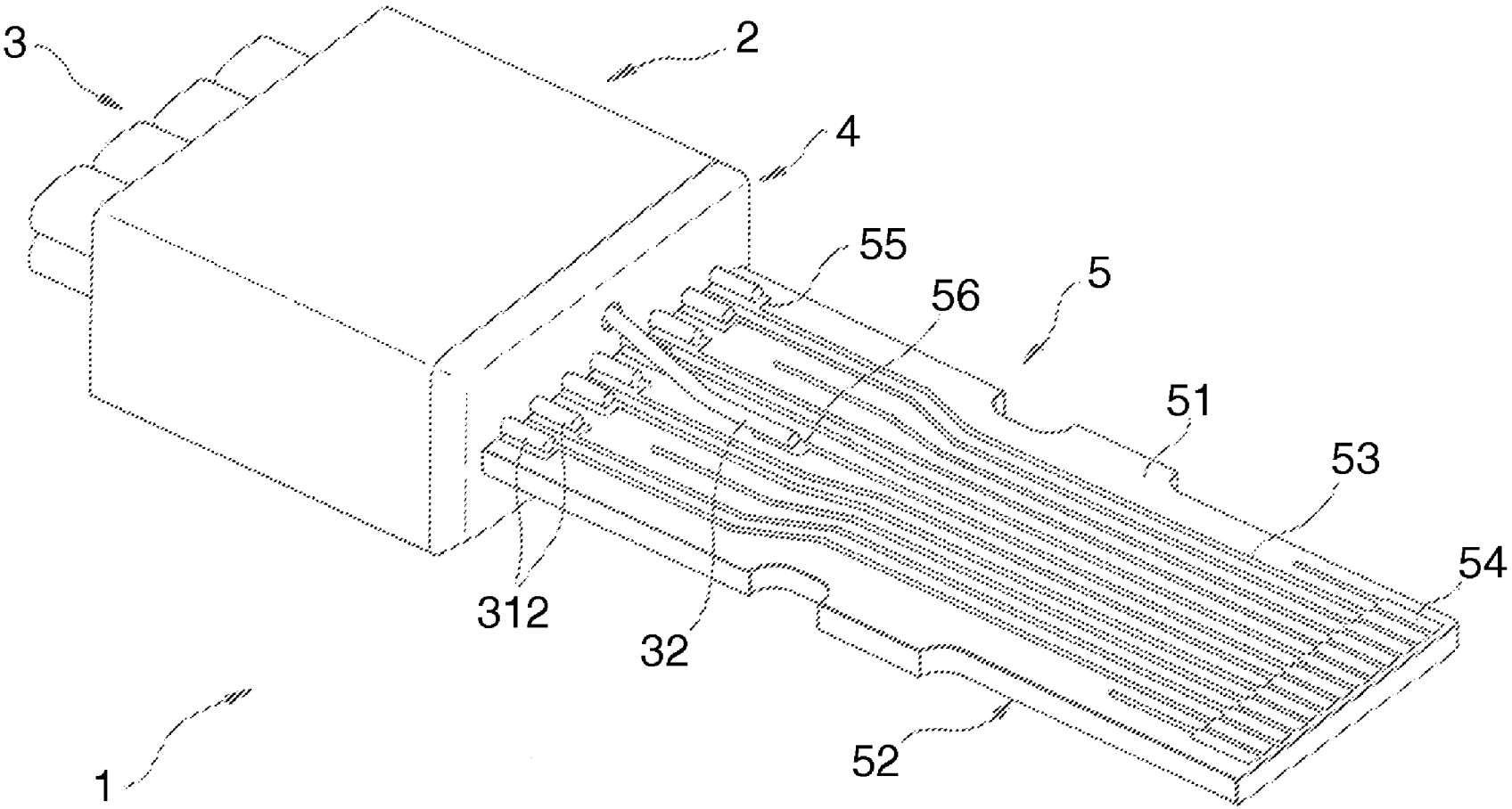
FIG. 1 A perspective view of a multicore cable connector according to an embodiment of the invention.
Figure 2:
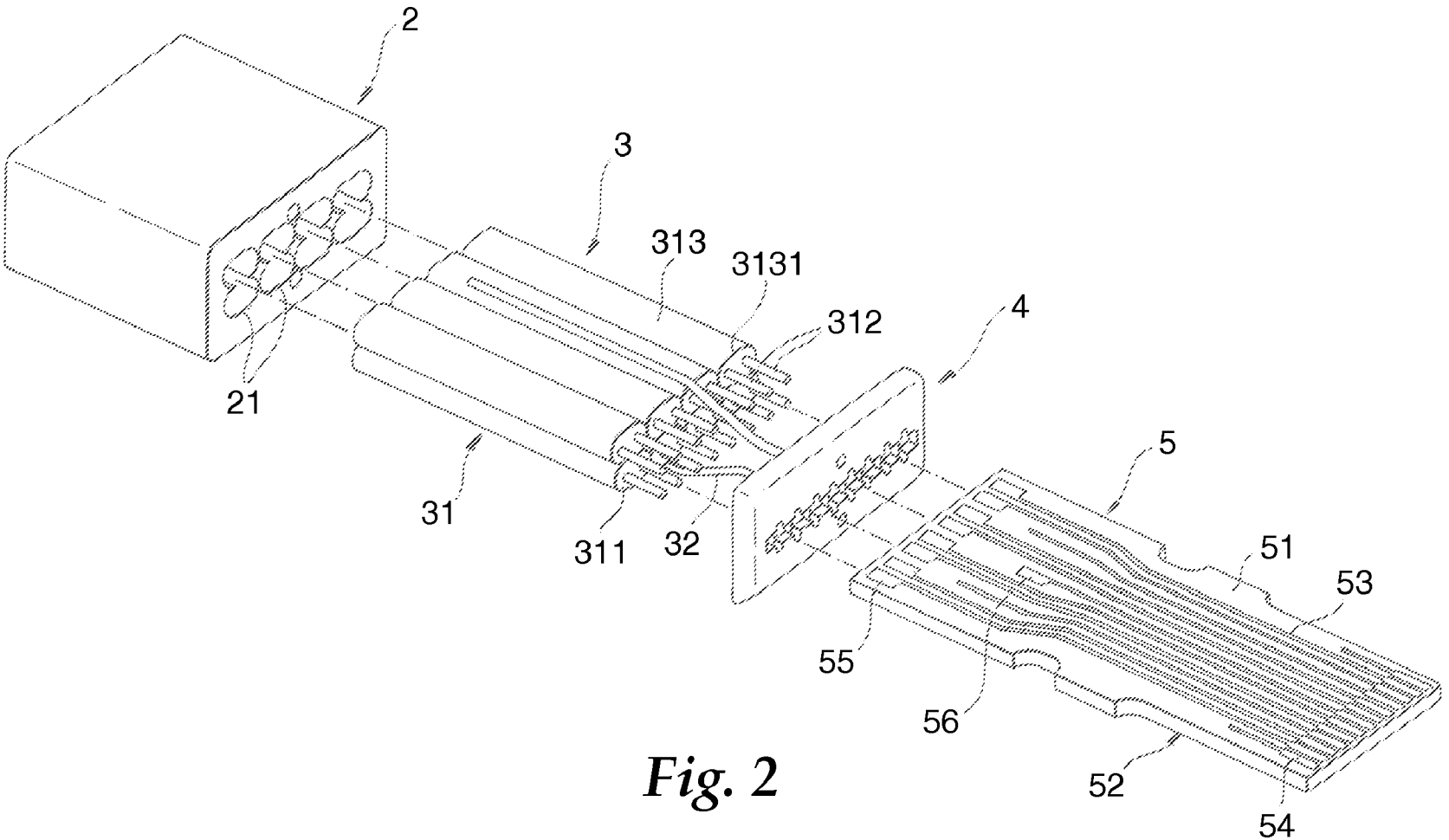
FIG. 2 An exploded assembly diagram of the connector shown in FIG. 1.

FIG. 1 is a perspective view showing the internal structure of the multicore cable connector according to a preferred embodiment of the invention, and FIG. 2 is an exploded assembly diagram thereof. The multicore cable connector (hereinafter referred to simply as the connector) 1 includes a cable fixing member 2, an aggregate cable 3 fixed in the cable fixing member 2, an aligning plate 4 for aligning the signal lines included in the aggregate cable 3 and a substrate 5 conductively connected with the signal lines of the aggregate cable 3. Though not shown, the connector 1 has a housing covering the whole internal structure shown in FIG. 1, which housing is formed in such a shape as to be fittable with a socket (not shown) conductively connected with the connector 1.

Figure 3:
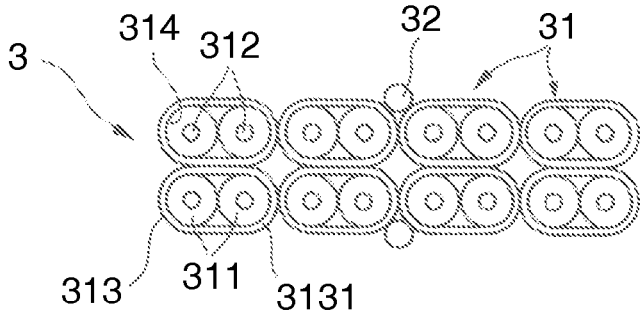
FIG. 3 A sectional view taken along the diameter of the aggregate cable of the connector shown in FIG. 1.

The aggregate cable 3, as shown in FIG. 3, includes a plurality of (eight, in the shown case) single cables 31 each having two signal lines 312 concentrically covered by insulating coatings 311, respectively, and a ground layer 313 with a conductive copper foil or the like arranged around the two signal lines and laminated on a base member 314 of PET or the like. The aggregate cable 3 further includes conductive drain wires 32 arranged along the outer periphery of a plurality of the single cables 31. Though not shown, the aggregate cable 3, on the far side from the substrate 5 relative to the housing 2, includes an insulating cladding for collectively covering the plurality of the single cables 31 and the drain wires 32 into a substantially circular cable contour. In the shown case, eight single cables are juxtaposed in two rows each with four single cables in the area having no cladding on the substrate 5. Each ground layer 313 of the single cables has the conductive surface of a copper foil or the like directed outward of the single cables in contact therewith electrically at the same potential. The shown case includes two drain wires 32 arranged parallel to the aggregate of a plurality of single cables 31 and in contact with the ground layer 313 of at least one single cable 31, which ground layer if in electrical contact with the ground layers 313 of the other single cables 31. Alternately, the drain wires 32 may be arranged spirally around the aggregate of a plurality of the single cables 31 in contact with each ground layer 313 of the plurality of the single cables 31. Thus, the drain wires 32 have the function shared by the plurality of the single cables. According to this embodiment, therefore, the drain wire is not arranged for each single cable, thereby reducing the points of soldering on the substrate 5. The single cables 31 according to this invention have the structure in which the ground layers 313 are in contact with each other, and therefore, unlike in the ordinary cable, have no resin coating layer on the outer periphery of the ground layers 313.

The substrate 5 has a front surface 51 and a back surface 52 (the back surface is not visible in FIGS. 1 and 2), each formed with a wiring pattern 53. An end of each wiring pattern 53 is formed with a land 54 making up a contact point with a socket (not shown) to be fitted with the connector 1, and the other end of each wiring pattern 53 is formed with a signal line mounting unit 55 making up a contact point with the signal lines 312 and a drain wire mounting unit 56 making up a contact point with the drain wire 32. The back surface of the substrate 5, like the front surface thereof, is similarly formed with a wiring pattern, a land and mounting units.

Figure 4A:
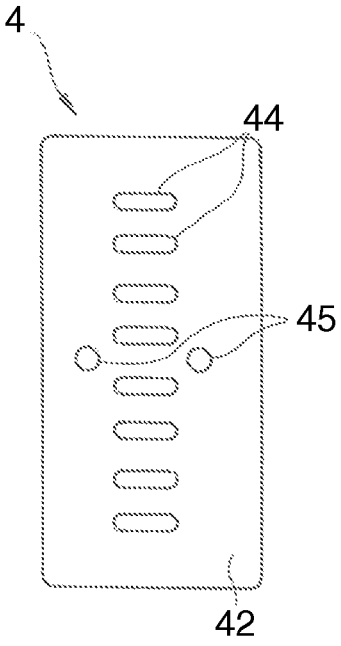
FIG. 4 (*a*) is a diagram showing the back surface of the aligning plate included in the connector shown in FIG. 1, (*b*) a diagram showing the front surface of the aligning plate, and (*c*) a sectional view taken in line IV-IV in (*b*).
Figure 4B:
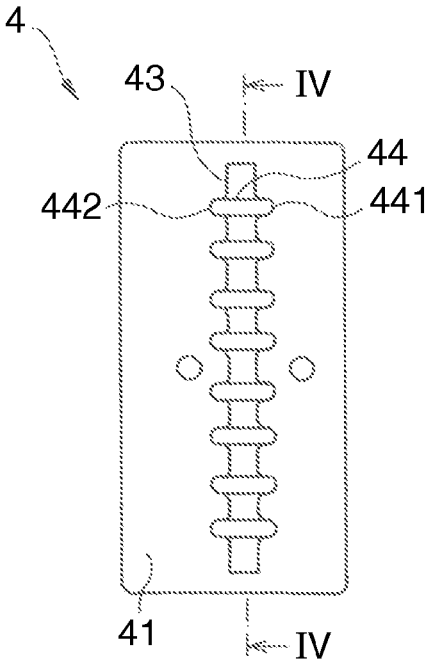
Figure 4C:
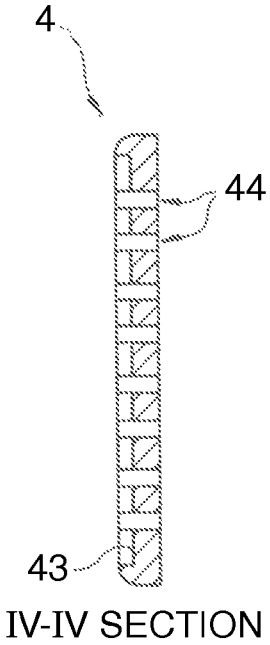

The aligning plate 4, as shown in FIGS. 4(*a*) to (*c*), has a front surface 41 and a back surface 42. The front surface 41 is formed with a substrate receiving portion 43 for receiving an end of the substrate at the time of assemblage. The substrate receiving portion 43 may be either a depression as shown or a through hole. In the case of a through hole, however, the exposed portion (length of exposure) of the signal line of each single cable can be shortened. In other words, the distance between the root of the exposed portion of each insulating coating 311 and the soldered point of the corresponding signal line 312 on the substrate 5 can be shortened. In the configuration with the substrate receiving portion 43 formed as a depression at least partially in contact with the substrate end, on the other hand, the relative positions of the substrate 5 and the aligning plate 4 can be defined in the longitudinal direction of the cable. Also, the aligning plate 4 has a plurality of signal line receiving holes 44 for receiving the signal lines 312. As shown, each signal line receiving hole 44 is a vertically long through hole, or more specifically, has an upper end portion 441 and a lower end portion 442 projected from an upper edge and a lower edge, respectively, of the outer periphery of the substrate receiving portion 43. The upper end portion 441 and the lower end portion 442 each have the function of accurately positioning each signal line 312 at the time of assembling the connector. The aligning plate 4 further has drain wire receiving portions 45 arranged at a distance from the substrate receiving portion 43 for receiving the drain wires 32. The drain wire receiving portions 45, which are each shown as a hole in this case, may alternatively be a notch. The aligning plate 4 further may have depressions on the back surface 42 for receiving the plurality of the insulating coatings 311 around the signal lines 312, respectively.

Next, the steps of assembling the connector 1 are explained. First, in the aggregate cable 3 shown in FIG. 2, the insulating coating 311 is cut off for a predetermined length in the longitudinal direction at an end of each single cable 31 so that only the signal lines 312 are exposed. Each single cable 31 has a ground layer 313 on the outer surface thereof, and unlike the ordinary cable, has no resin coating layer on the outside of the ground layer 313. Therefore, the insulating coating 312 can be removed from the immediate neighborhood of the end portion from which the ground layer 313 is cut off, and thus the length of the impedance-mismatched portion can be minimized. In the presence of the resin coating layer on the outside of the ground layer 313, the ground layer 313 could be cut off substantially in the same plane as the end portion of the resin coating layer. In this case, however, the cutting blade for removing the insulating coating layer 311 cannot be brought into contact with the immediate neighborhood of the end portion with the resin coating layer (on ground layer 313) removed, and the insulating coating layer 311 would be projected from the resin coating layer (on ground layer 313). As a result, the impedance of the signal lines would be disturbed in the projected portion of the insulating coating layer 311.

Figure 5:
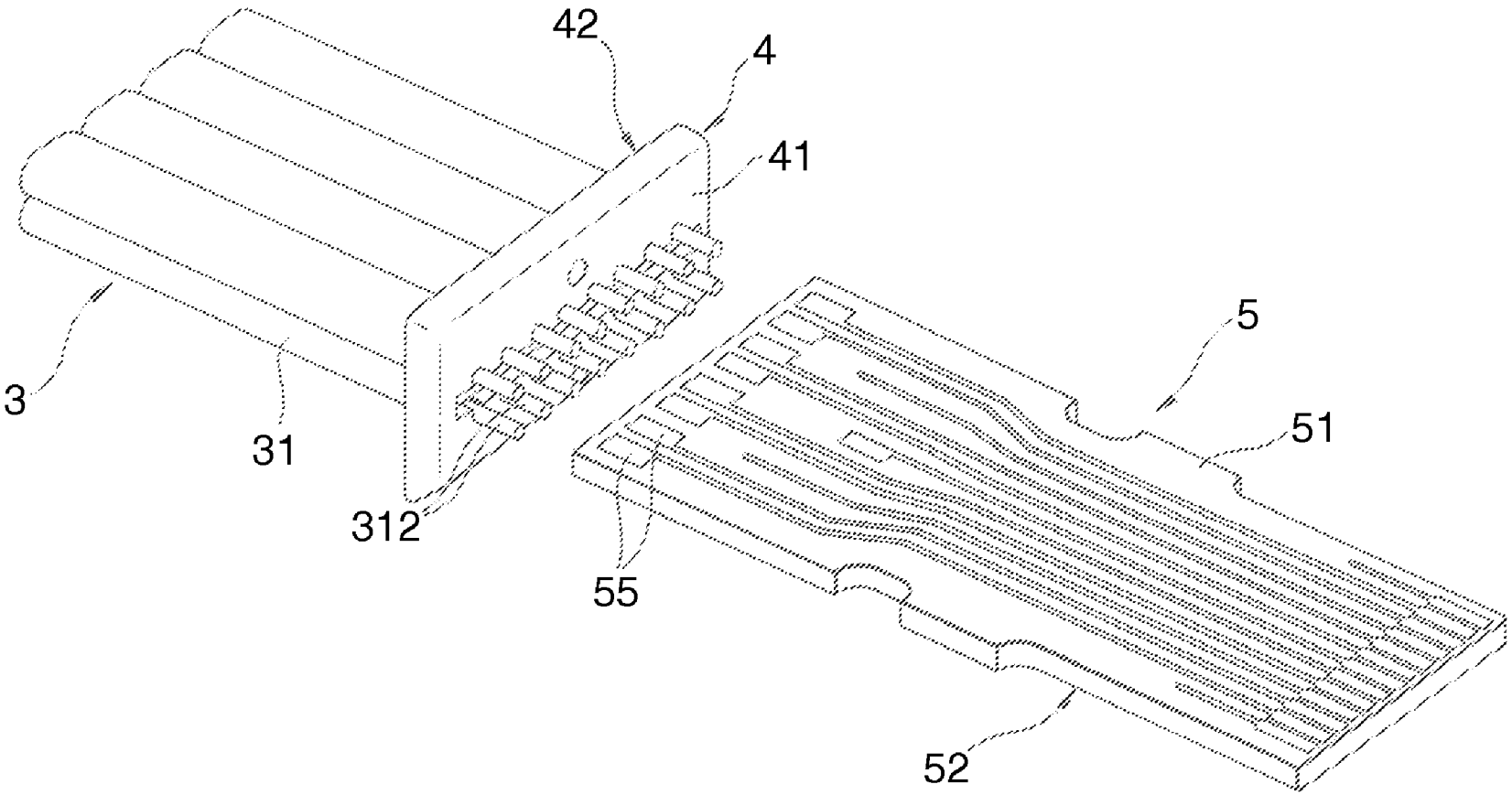
FIG. 5 A perspective view showing the assembly steps of the connector shown in FIG. 1 and a state in which the signal lines are inserted into the signal line receiving holes of the aligning plate.

Next, as shown in FIG. 5, the signal lines 312 exposed from an end of each single cable 31 are inserted into the upper end portion 441 and the lower end portion 442 (FIG. 4) of the signal line receiving hole 44 of the aligning plate 4 from the back thereof. The upper end portion 441 and the lower end portion 442 have substantially the same size as the contour of the signal line 312 and are opposed to each other with the substrate receiving portion 43 therebetween. The distance between the rows of the signal lines thus aligned is substantially equal to the thickness of the substrate 5, and therefore, the signal lines are accurately set in position, i.e. aligned on the substrate 5. Also, the end surface 3131 of each ground layer 313 (FIGS. 2 and 3) is preferably in contact with the back surface 42 of the aligning plate 4. The word "contact" as used herein is not necessarily required to be the physical contact but may include a case in which a gap causing an ignorably small impedance disturbance in terms of the frequency of the transmitted signal is formed between the end surface 3131 of the ground layer and the back surface 42 of the aligning plate 4. As a result, a constant impedance of the single cables can be maintained before the aligning plate 4. Further, the impedance disturbance of this portion can be reduced by adjusting the gap between the end portion of the substrate 5 and the end portions (roots of the exposed portions) of the insulating coatings (on the single cables). In the process, the thickness from the bottom surface to the back surface 42 of the substrate receiving portion 43 of the aligning plate 4 is set to a size conforming with the impedance to be achieved. Then, the optimum impedance can be achieved in this portion simply by setting the substrate 5 and the cable mechanically on the aligning plate 4.

Figure 6:
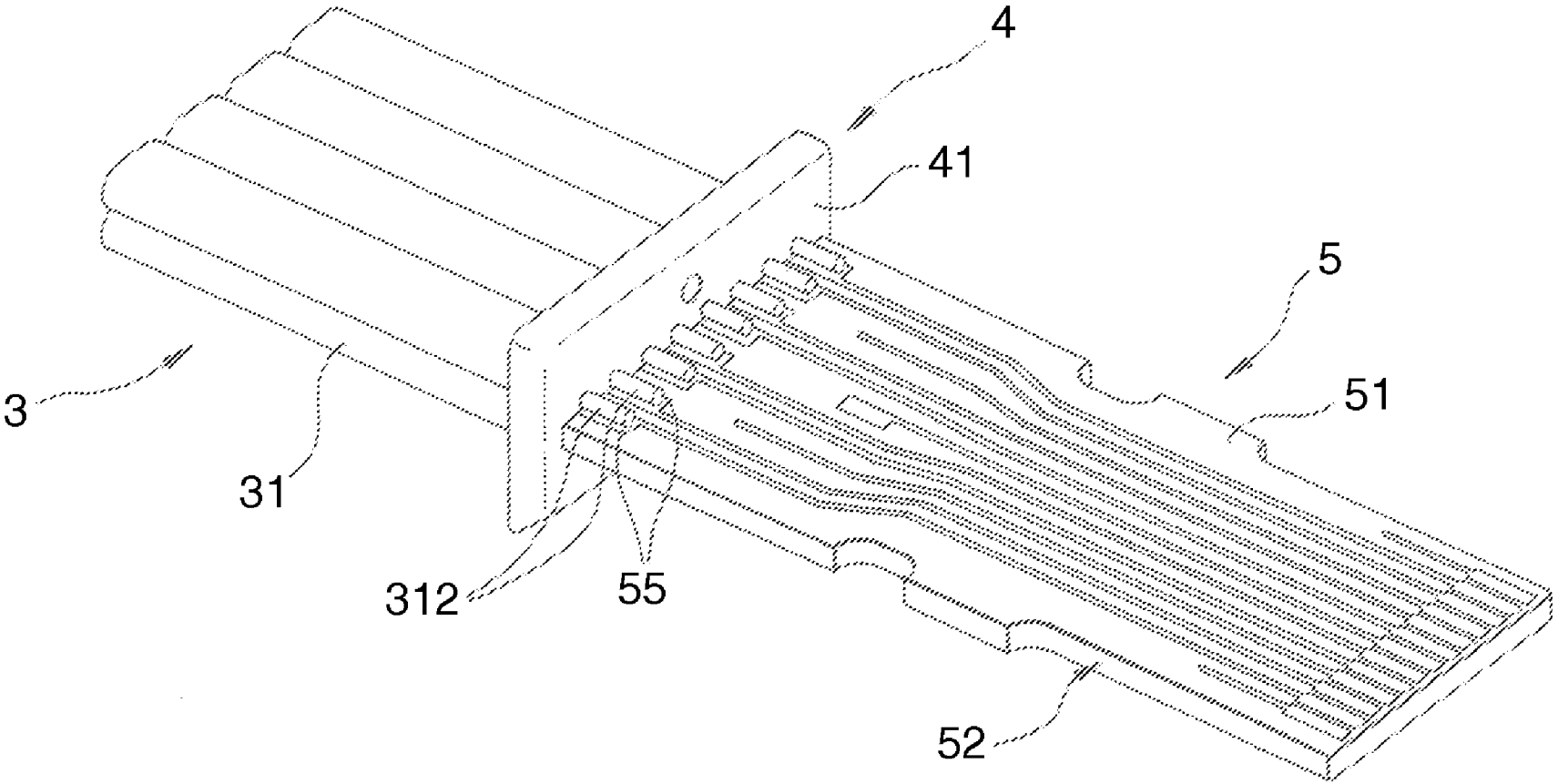
FIG. 6 A perspective view showing the assembly steps of the connector shown in FIG. 1 and a state in which the signal lines projected from the aligning plate are conductively connected to the wiring pattern of the substrate.

Next, as shown in FIG. 6, the signal lines projected from the front surface 41 of the aligning plate 4 are conductively connected to the signal line mounting portions 55, respectively, formed on the two surfaces of the substrate 5. The conductive connection can be established manually, for example, by soldering. In view of the fact that each signal line is accurately set in position by the aligning plate 4 with the elastic insulating coating exposed, however, the soldering job can be automated with comparative ease.

Figure 7:
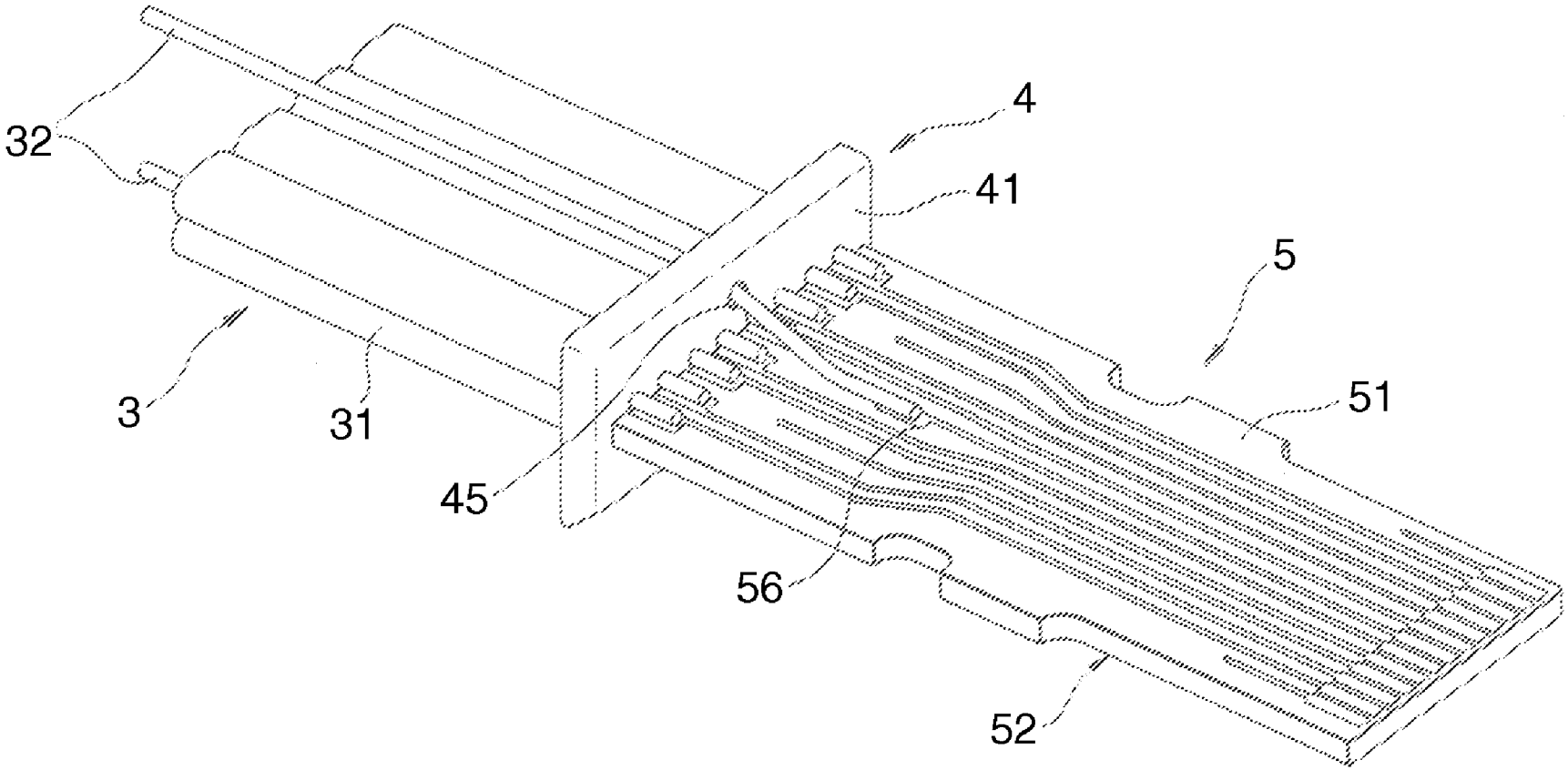
FIG. 7 A perspective view showing the assembly steps of the connector shown in FIG. 1 and a state in which the drain wires are passed through the drain wire receiving holes of the aligning plate and then conductively connected to the wiring pattern of the substrate.

Next, as shown in FIG. 7, the two drain wires 32 are inserted into the aligning plate 4 from the back and projected from the front surface 41 through the drain wire receiving holes 45 of the aligning plate 4, and conductively connected to the drain wire mounting portions 56 formed on the two surfaces of the substrate 5. Also in this case, the conductive connection can be established by, for example, the manual soldering work. Although FIGS. 5 to 7 show that the signal lines are conductively connected on the front surface 51 of the substrate 5, a similar operation is performed also on the back surface 52.

As shown in FIG. 1, the cable fixing member 2 is arranged in such a manner as to surround the outside of the aggregate cable 3, and fixed integrally to the aligning plate 4 and the aggregate cable 3 using an adhesive on the aggregate cable. The adhesive may be applied on the aggregate cable in advance and then the cable fixing member 2 may be arranged to surround the aggregate cable, or after arranging the cable fixing member 2 in advance, the adhesive may be injected in the gap between the cable fixing member 2 and the aggregate cable 3 or the aligning plate 4 through an opening not shown. The upper end portion 441 and the lower end portion 442 of each signal line receiving hole 44 of the aligning plate 4 are formed to substantially the same size as the signal line, and therefore, the aligning plate 4 has the function of blocking the outflow of the adhesive toward the substrate when the adhesive is applied to the back surface thereof. The adhesive flowing out toward the substrate side of the aligning plate 4 would cover the soldered portion between the signal lines 312 and the substrate 5 and the wiring pattern 53 of the substrate 5 and disturb the impedance. In view of this, as shown in FIG. 2, cable receiving holes 21 having a shape complementary with the contour of the single cable 31 may be formed, or a configuration using a cable fixing member may be employed in which a plurality of the single cables 31 and the aligning plate 4 are integrally fixed on the back surface of the aligning plate 4 by solidifying the resin component such as the hot melt adhesive or the thermoplastic resin on the aggregate cable. In the process, the cable fixing member may be formed using a die or the like. Finally, a housing not shown corresponding to the connector (socket) to be fitted is mounted thereby to complete the multicore cable connector 1. By fixing one or both of the aligning plate 4 and the cable fixing member 2 on the housing, the tension which may be applied to the aggregate cable 3 is prevented from being transmitted to the soldered portion and causing an electrical disconnection.

In the connector 1, as described above, the distance between each signal line of the single cable 31 and the ground layer is constant and therefore the impedance of the aggregate cable is also constant up to the back surface of the aligning plate 4. For the portion subsequent to the signal line mounting portion 55 with each signal line connected to the substrate 5, however, the impedance is accurately defined by the wiring pattern 53 formed on the substrate 5. In the connector according to this invention, therefore, the impedance disturbance that could pose the problem in high-speed transmission is limited to the area between the position where the signal lines cease to be covered by the insulating coating 311 and the signal mounting portion 55 of the substrate 5, i.e. the area of a length corresponding to the thickness of the aligning plate 4. As compared with the prior art, therefore, the length of the area where the impedance disturbance may occur can be reduced remarkably. Thus, a cable connector is provided in which the impedance disturbance in high-speed transmission poses substantially no problem.

For the reasons described above, the aligning plate 4 is desirably as thin as possible from the viewpoint of impedance as long as it has the function of positioning each signal line and the required strength. By forming, in the aligning plate 4, a conductive layer having a distance with the signal lines equal to the distance between the ground layer and the signal lines in the single cable along the thickness of the aligning plate 4, however, the impedance similar to that of the single cable can be obtained also in the aligning plate. In this case, the aligning plate is not required to be reduced in thickness taking the impedance into consideration.

The invention claimed is:

1. A multicore cable connector comprising:

an aggregate cable including a plurality of single cables each having a pair of signal lines covered concentrically by insulating coatings, respectively, and a ground layer of a conductive foil arranged around the signal line pair and a conductive drain wire arranged along at least one ground layer of the plurality of the aggregate single cables;

a substrate having a front surface and a back surface, and a wiring pattern on each of the front surface and the back surface; and an aligning plate having a front surface and a back surface, a substrate receiving portion formed on the front surface, a plurality of signal line receiving holes constituting a plurality of vertically long through holes for receiving the respective signal lines, and a drain wire receiving portion for receiving the drain wire;

wherein an end of the substrate is received by the substrate receiving portion of the aligning plate, end surfaces of the ground layers of the cable are in contact with the back surface of the aligning plate, the signal lines are electrically connected to mounting portions of the wiring patterns, and the drain wire is connected electrically to a mounting portion of a wiring pattern.

2. The connector of claim 1, wherein the substrate receiving portion of the aligning plate is a depression.

3. The connector of claim 1, wherein the substrate receiving portion of the aligning plate is a through hole.

4. The connector of claim 1, wherein impedance disturbance during use is limited to a length approximating a thickness of the aligning plate.

* * * * *